US006234720B1

(12) United States Patent
Queen et al.

(10) Patent No.: US 6,234,720 B1
(45) Date of Patent: May 22, 2001

(54) REDUCED SKIN FRICTION SHEET PILE

(75) Inventors: Frankie A. R. Queen, Lawrenceville; Jimmy Don Sailors, Norcross, both of GA (US)

(73) Assignee: Foundation Technologies, Inc., Tucker, GA (US)

( * ) Notice: Subject to any disclaimer, the term of this patent is extended or adjusted under 35 U.S.C. 154(b) by 0 days.

(21) Appl. No.: 09/353,760

(22) Filed: Jul. 14, 1999

Related U.S. Application Data

(63) Continuation-in-part of application No. 08/982,854, filed on Dec. 2, 1997, now Pat. No. 5,931,604
(60) Provisional application No. 60/032,192, filed on Dec. 2, 1996.

(51) Int. Cl.[7] ..... E02D 11/00
(52) U.S. Cl. ..... 405/232
(58) Field of Search ..... 405/229, 231, 405/232, 262, 274, 275, 276, 277, 278–281; 175/65, 66; 173/1

(56) References Cited

U.S. PATENT DOCUMENTS 4,721,418 * 1/1988 Queen ..... 405/231
5,213,166 * 5/1993 Watanabe et al. ..... 173/1
5,226,751 * 7/1993 Doleshal ..... 405/211.1
5,333,971 * 8/1994 Lewis ..... 405/281

* cited by examiner

*Primary Examiner*—Robert E. Pezzuto
(74) *Attorney, Agent, or Firm*—Thomas, Kayden, Horstemeyer & Risley

(57) ABSTRACT

A preferred embodiment of the reduced skin friction driven sheet pile is particularly suited for driving into soils having compressible soil disposed above harder soil, with the sheet pile being configured to extend downwardly through the compressible soil into the harder soil. Preferably, the sheet pile is of formed sheet material, and incorporates an elongated opposed exterior surfaces and elongated opposed side edges which are shaped for interlocking with side edges of duplicate ones of the sheet pile. A friction reduction coating is adhered to the opposed exterior surfaces over a predetermined portion of the length of the sheet pile so that when the sheet pile is driven through the compressible soil and into the harder soil, the friction reduction coating contacts the compressible and/or harder soil and decreases the coefficient of friction between the opposed exterior surfaces of the sheet pile and the compressible and/or harder soil.

13 Claims, 3 Drawing Sheets

REDUCED SKIN FRICTION SHEET PILE

CROSS REFERENCE TO RELATED APPLICATIONS

This application is a Continuation-In-Part Application claiming the benefit of and priority to U.S. application Ser. No. 08/982,854, filed on Dec. 2, 1997, now U.S. Pat. No. 5,931,604, and priority to U.S. Provisional Application Ser. No. 60/032,192, filed on Dec. 2, 1996.

BACKGROUND OF THE INVENTION

1. Field of the Invention

The present invention generally relates to sheet piles which are driven through soils to form retaining walls or bulkheads. More specifically, the present invention relates to a reduced skin friction sheet pile which minimizes the downward frictional force (down drag) applied to the sheet pile by the settling of compressible soils surrounding the pile after the pile has been driven.

2. Description of the Related Art

Sheet piles are piles that interlock with each other to form walls or bulkheads that are capable of retaining soils and/or water depending on the particular application. Typically, these piles are relatively long, slender structural members which can be formed with any one of a variety of cross-sectional shapes including flat, U-shaped, and Z-shaped configurations, among others. The side edges of the sheet piles are configured to interlock with each other so that the piles can be arranged in edge-to-edge relationship to form bulkheads of various shapes. The sheet piles usually are driven through compressible soils to a sufficient depth so that the downwardly driven ends of the sheet piles penetrate harder underlying materials to a specified depth or penetration or until refusal is achieved. Typically, significant support of the piles is provided by these underlying harder materials.

Pile penetration results in a downward frictional force on the piles that is a function of the horizontal stress applied to the pile by the soil and the coefficient of friction of the pile's exterior surfaces relative to the soil. This downward force can result in failure of a sheet pile bulkhead due to an unexpected downward movement of the piles, or increase the time required to install the pile.

For many years, departments of transportation, structural engineers and geotechnical engineers have struggled with the problem of how to reduce downward frictional forces imposed upon piles. Many costly measures have been implemented to address this problem.

Sheet piles are installed without consideration for the downward friction force as part of the pile design. This method results in considerable increased construction cost.

In cases in which the anticipated structural load on the piles is increased to account for a downward frictional force anticipated, this results in a higher capacity pile which requires driving the pile farther into the harder consistency soils, thereby requiring an increase in pile length and an increase in the capacity of the pile driving hammer capable of driving a pile to a higher criteria. In some cases, these requirements increase the cost of pile driving and the length of time for pile installation and may require an increased cross sectional area of the pile to allow for the higher capacity.

Historically frictional considerations have not been an issue when installing sheet pilings. They have generally been overdriven which usually results in substantial added cost of installation.

Sheet piles oftentimes are temporarily driven into soils and then removed when associated work has been completed, such as when a temporary bulkhead for diverting water is required, or for accommodation of staged construction. As sheet piles are installed, sometimes cohesive soils are encountered and it becomes difficult to penetrate and friction becomes a major problem. The piles are difficult to install causing a tremendous drain on labor and equipment resources. During removal of the piles, frictional forces between the outer surface of the piles and the soils surrounding the piles increases the extraction force which must be exerted upon the piles in order to pull the piles form the soils. Depending upon the particular characteristics of the surrounding soil, extraction of such a temporarily driven pile can be extremely difficult, and can place excessive strain upon the pile removal equipment and involves additional time spent at the construction site.

Therefore, there is a need for improved sheet piles which address these and other shortcomings of the prior art.

BRIEF SUMMARY OF THE INVENTION

Briefly described, the present invention relates to a reduced skin friction sheet pile which reduces the downward frictional force applied to the pile by the settling of compressible soils surrounding the pile during and after the pile has been driven into the soil and upon extraction. A preferred embodiment of the reduced skin friction driven sheet pile is particularly suited for driving into soils having compressible soil disposed above harder soil, with the sheet pile being configured to extend downwardly through the compressible soil into the harder soil. Preferably, the sheet pile is formed of sheet material, such as steel, and incorporates elongated opposed exterior surfaces and elongated opposed side edges which are shaped for interlocking with side edges of duplicate ones of the sheet pile. A friction reduction coating is adhered to the opposed exterior surfaces over a predetermined portion of the length of the sheet pile so that when the sheet pile is driven through the compressible soil and into the harder soil, the friction reduction coating contacts at least the soft compressible soil, and thereby decreases the coefficient of friction between the opposed exterior surfaces of the sheet pile and the soft compressible soil.

In accordance with another aspect of the present invention, a preferred method includes the steps of: (1) providing a sheet pile formed of extruded sheet material, elongated and of constant size and shape along its length and having opposed exterior surfaces and elongated side edges shaped for connection to side edges of duplicate ones of the sheet pile; (2) determining the portions of the sheet piles to contact the soils; (3) applying a friction reduction coating to the opposing exposed exterior surfaces of the portions of the sheet piles to contact the soils, and; (4) driving the sheet piles into the soils. In those applications where the soils include both a compressible soil layer and an underlying harder soil layer, the step of determining the portions of the sheet piles to contact the soils preferably includes the steps of: (1) determining the depth of the compressible soil layer, and; (2) determining the portions of the piles to contact the compressible soil layer, so that the friction reduction coating need only be applied to the opposing exterior surfaces of the portions of the piles to contact the compressible and/or harder soil layers after the piles are driven into the soils.

In accordance with another aspect of the present invention, an alternative method includes the steps of: (1) providing first and second sheet piles of similar configuration, the first and second sheet piles being formed of extruded sheet material, elongated and of constant size and shape along their lengths and each having opposed exterior surfaces and elongated opposed side edges configured for interlocking with the side edges of the other sheet pile; (2) determining the depth to which the sheet piles are to be disposed into the soil; (3) applying a friction reduction coating to the opposed exterior surfaces of the portion of the first sheet pile to contact the soil after being driven; (4) driving the portion of the first sheet pile to which the friction reduction coating has been applied into the soil; (5) connecting together a side edge of the first sheet pile and a side edge of the second sheet pile, and; (6) driving the portion of the second sheet pile to which the friction reduction coating has been applied into the soil so that the first and second sheet piles interlock to form a first wall structure.

Another typical methodology is, a second wall structure can be formed that is spaced from and approximately parallel to the first wall structure so that soil can be effectively removed from between the wall structures to form an evacuated cavity without hazard of the soils outside of the walls flowing into the excavation. After work is completed within the cavity, at least a portion of the cavity can be refilled with earth, and the sheet piles can be removed from the soil.

Other objects, features and advantages of the present invention will become apparent upon reading the following specification, when taken in conjunction with the accompanying drawings.

BRIEF DESCRIPTION OF THE SEVERAL VIEWS OF THE DRAWINGS

The accompanying drawings incorporated in and forming a part of the specification illustrate several aspects of the present invention, and together with the description serve to explain the principles of the invention. The components in the drawings are not necessarily to scale, emphasis instead being placed upon clearly illustrating principles of the present invention. In the drawings appended hereto, like numerals illustrate like parts throughout the several views.

DETAILED DESCRIPTION OF THE PREFERRED EMBODIMENT

Figure 1A:
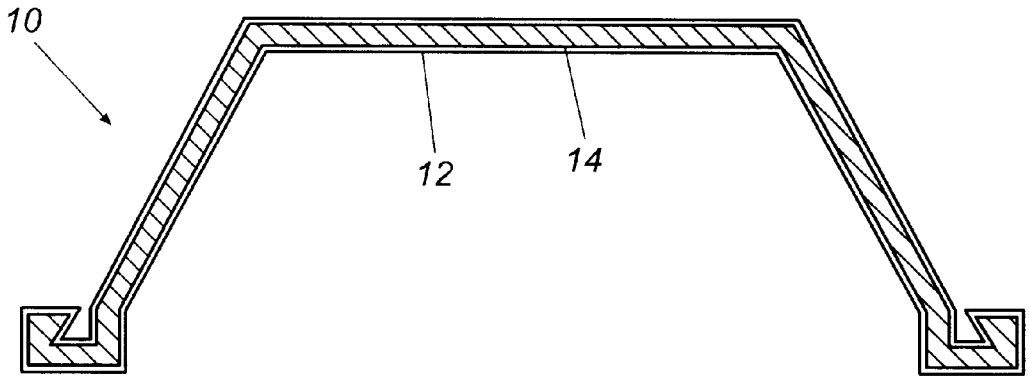
FIGS. 1A and B illustrate cross-sectional views of preferred embodiments of the reduced skin friction sheet piles of the present invention.
Figure 1B:
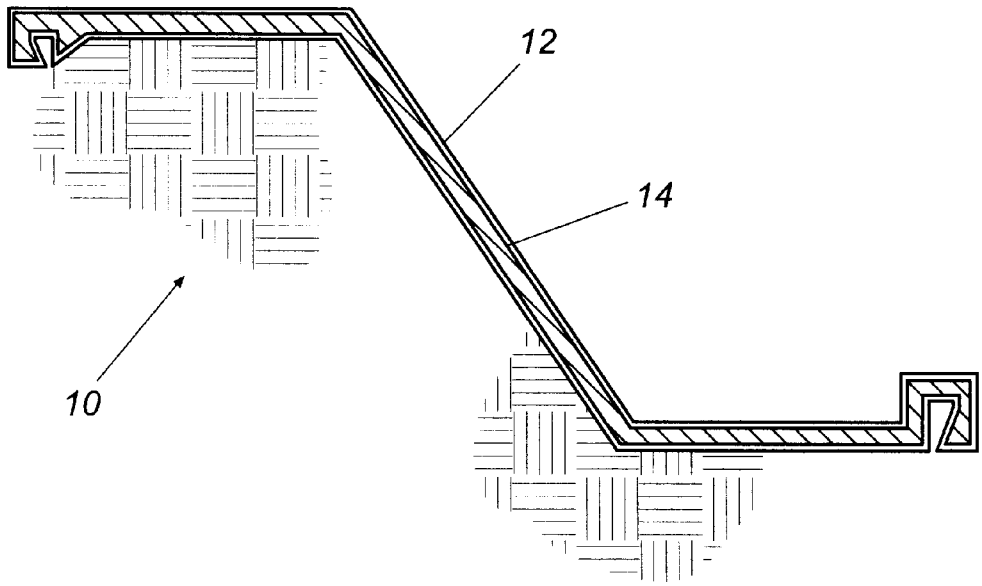
Figure 2:
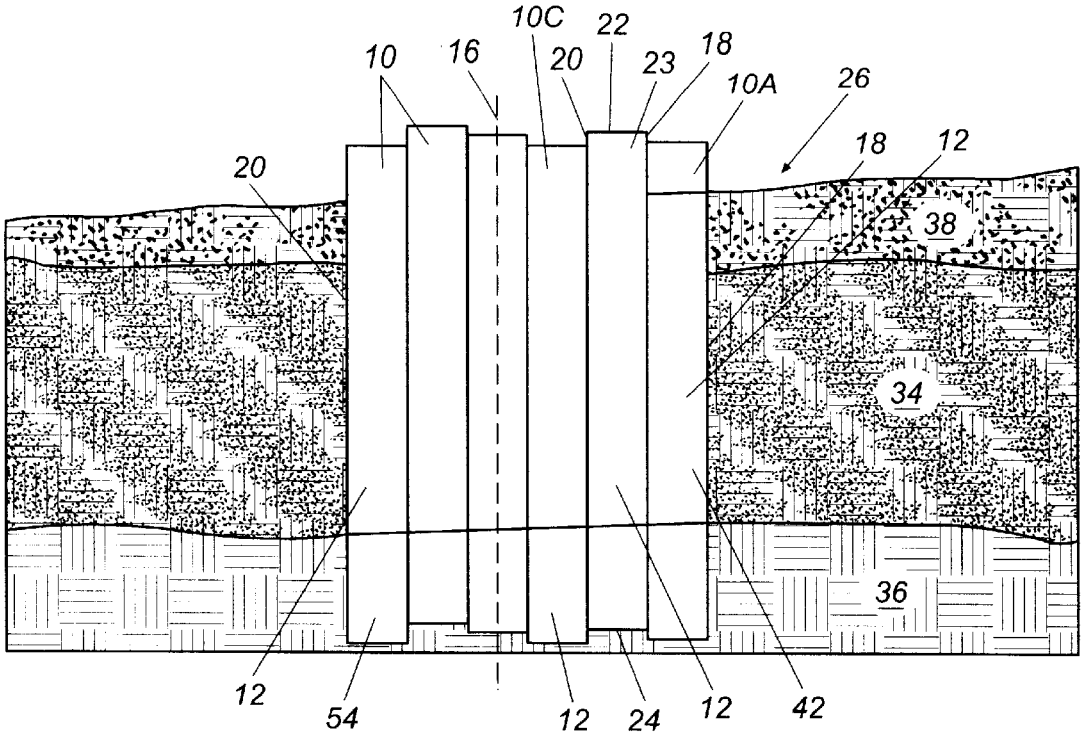
FIG. 2 illustrates a partially cut-away, side elevation of sheet piles of the present invention shown driven through compressive soil into relatively harder, cohesive soil.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims. In particular, FIGS. 1A and 1B illustrate cross-sectional views of several different embodiments of the sheet piles 10 of the present invention; however, numerous other cross-sectional configurations of sheet piles can be utilized in accordance with the teachings of the present invention. Additionally, for ease of description, only schematic representations of sheet piles are depicted in the FIGS. 2–5.

As shown in FIGS. 1A and 1B, a friction reduction coating 12 is applied to the exterior surfaces 14 of the piles 10. Typically, the piles 10 are made of steel. The friction reduction coating 12 is a compound, such as an epoxy, polymer, urethane, or copolymer, possessing sufficient strength and abrasion resistance to withstand the abrasion forces applied to the pile 10 during driving operations and also has a very low coefficient of friction relative to the soils into which the piles are to be driven. The coating 12 can be applied at either the point of manufacture or the construction site.

Figure 3:
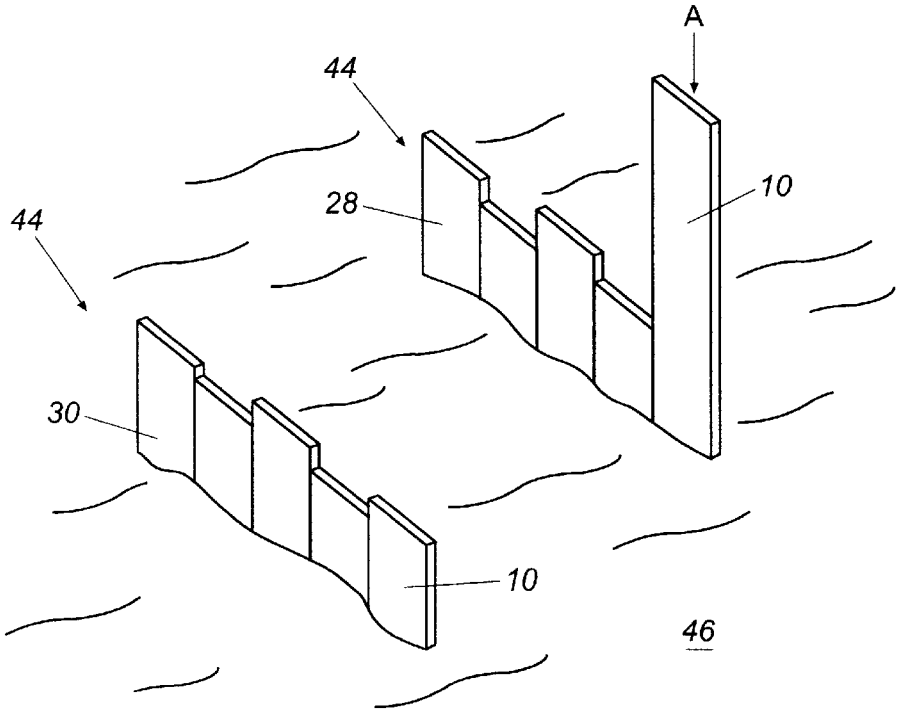
FIG. 3 is a perspective view of sheet piles arranged to form spaced retaining wall segments in accordance with a preferred method aspect of the present invention.
Figure 4:
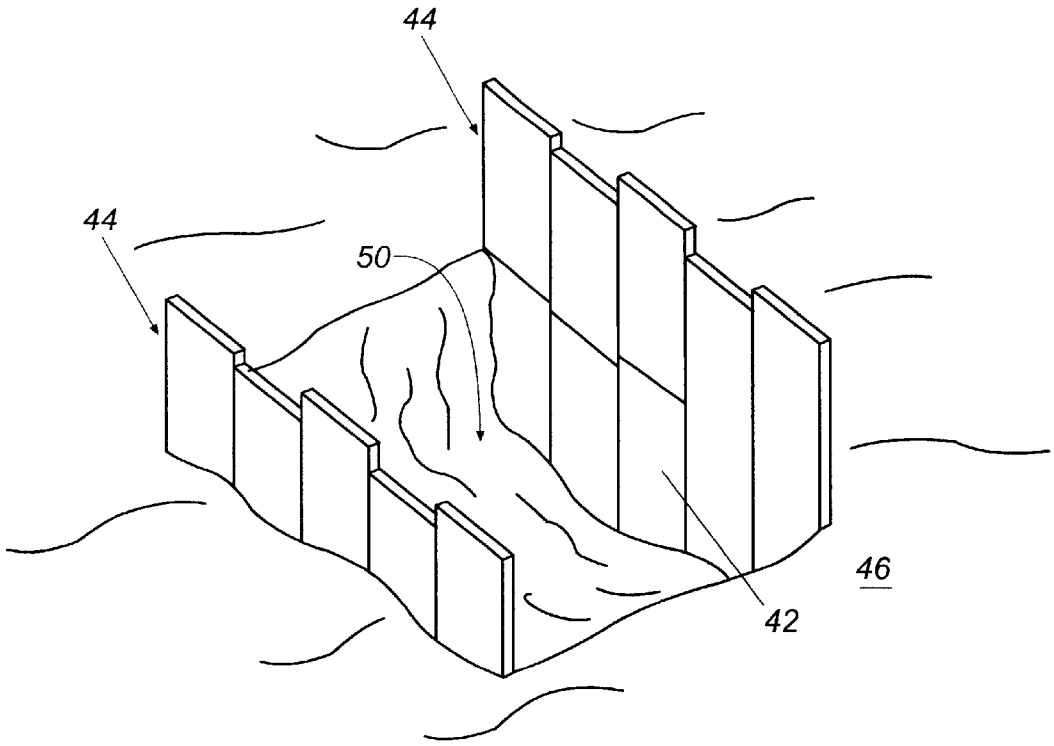
FIG. 4 is a perspective view of the sheet piles of FIG. 3, with soil removed from between the spaced retaining wall segments.
Figure 5:
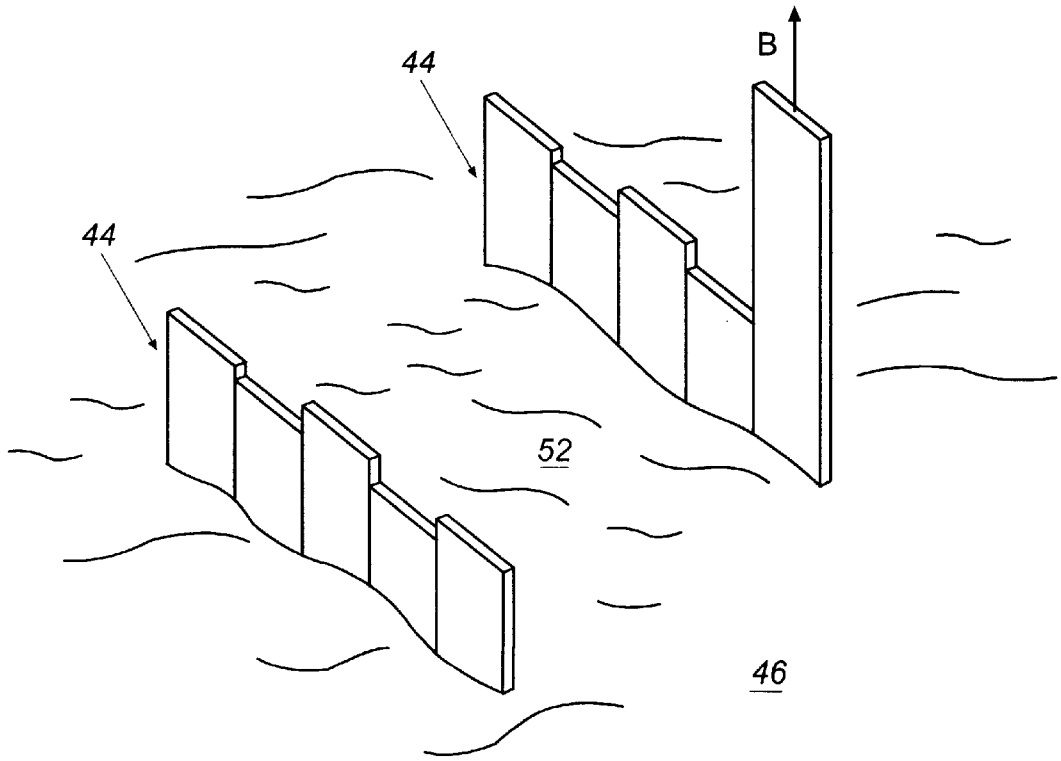
FIG. 5 is a perspective view of the sheet piles of FIG. 3, with fill placed between the spaced retaining wall segments and the sheet piles being removed.

As shown in FIG. 3, each of the piles 10 is formed as a generally elongated member possessing a longitudinal axis 16, opposing side edges, 18 and 20 respectively, that are substantially parallel to the longitudinal axis 16, and top and bottom edges, 22 and 24 respectively, that are substantially normal to the longitudinal axis. The side edges 18 and 20 are configured to interlock with the side edges of other such piles, so that a plurality of piles can be driven adjacent each other to form a retaining wall or bulkhead 26. Additionally, the piles 10 have inner and outer opposing surfaces, 28 and 30 respectively (described in detail hereinafter).

A pile 10 is driven into soil in a conventional manner, typically with its longitudinal axis being maintained in a substantially vertical, upright orientation. The piles 10 commonly are driven through an upper layer of relatively compressible soil 34 and into relatively harder, cohesive soil 36 therebelow, with the piles 10 being driven to a sufficient depth so that the cohesive soil 36 provides stability to the pile. As needed, additional ones of the piles 10 are then driven into the soil in a similar manner, with side edge of the piles being arranged to interlock with the side edges of adjacently disposed piles, thereby forming the bulkhead 26.

Depending upon the particular application, compacted fill 38 is added on top of the compressible soil 34, such as for raising ground level on at least one side of the bulkhead 26 to a suitable level. Detrimentally, the added weight of the compacted fill 38 applies stress to the underlying compressible soil 34 and the underlying cohesive soil 36. Typically, the cohesive soil 36 is able to support this stress without compressing significantly; however, oftentimes, the compressible soil 34 compresses under the newly applied stress which causes the compacted fill 38 and the compressible soil 34 to settle relative to the piles 10, which are supported by the relatively hard, cohesive soil 36 below. This results in a downward movement of the compacted fill 38 and compressible soil 34 relative to the piles 10, and allows the settling soils 38 and 34, which are in physical contact with the piles 10, to apply a downward force to the piles 10. Since, however, the friction reduction coating 12 has a low coefficient of friction relative to the soils 38 and 34, the downward force caused by these settling soils is reduced.

The friction reduction coating 12 need only be applied to a compressible soil contact portion 42 of the pile 10, e.g on pile 10A, the portion of the pile that is expected to have soils settling relative thereto after the pile 10A has been driven incorporates the coating 12. However, in other applications, the entire upper portion of the pile may be coated (e.g. pile 10B), or alternatively, the entire pile may be coated (e.g. pile 10C).

The location of the compressible soil contact portion 42 of the pile is determined by measuring the depth of the soft compressible soils 34 at the location for pile placement by soil testing in a known manner. Once the depth of the compressible soils 34 is determined, the pile 10 is marked at a length which corresponds to the bottom of the compressible soils 34 so that when the pile is driven, the mark substantially aligns with the bottom of the compressible soils 34. Starting at this mark and measuring a distance corresponding to the compressible soil depth toward the top of the pile 10, a second mark is placed on the pile 10. The area between these two marks represents the soft soil contact portion 42 of the pile.

Additionally, the friction reduction coating 12 protects piles against corrosion by providing an additional physical moisture barrier between soil moisture, i.e. ground water, and the pile.

As shown in FIG. 3, and in accordance with another aspect of the present invention, several piles 10 can be driven into soil, in direction A, in the aforementioned interlocking arrangement so as to form two retaining wall segments 44 which are spaced from each other. The piles 10 of the walls segments 44 are driven to a sufficient depth to provide lateral support to soil 46 located adjacent the opposing outer surfaces 30 of the piles. So configured, soil 46 disposed between the inner surfaces 28 of the piles can be removed (FIG. 4), such as with a back hoe (not shown), for instance, with the retaining wall segments 44 preventing the soil 46 from falling into and refilling an excavated cavity 50 which is formed between the retaining wall segments. The excavated cavity 50 is formed to a sufficient size, as necessary, and then can be utilized, such as by placing conduit therein. The cavity 50 then can be filled with a fill 52 (FIG. 5), and the ground level adjusted, as desired. Once the cavity 50 has been filled, the piles then can be removed, in direction B, in a conventional manner. Preferably, at least the compressible soil contact portion 42 of the piles are coated with the friction reduction coating.

The friction reduction coating 12 promotes efficient driving of the piles 10 into and removal of the piles from soil, thereby improving the efficiency of the aforementioned method. Additionally, since a preferred embodiment of the pile 10 only incorporates the friction reduction coating at the compressible soil contact portion 42 of the pile, the bottom end or cohesive soil contact portion 54 (FIG. 2) of the pile provides increased frictional contact with the soil, thereby facilitating secure engagement of the retaining wall segment 44 within the soil, and thus, providing a more secure retaining wall segment as soil is removed from between the spaced retaining wall segments 44.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. A reduced skin friction sheet pile for driving into soils and forming with duplicate ones of said sheet pile a wall structure, the soils having compressible soil disposed above harder soil and wherein said sheet pile is configured to extend downwardly through the compressible soil into the harder soil, said reduced skin friction sheet pile comprising:

said sheet pile being formed of sheet material, elongated and of constant size and shape along its length and having opposed exterior surfaces and elongated opposed side edges shaped for interlocking with side edges of duplicate ones of said sheet pile, a friction reduction coating adhered to said opposed exterior surfaces of said sheet pile with enough strength and abrasion resistance to withstand the abrasion forces applied to the pile during driving operations into the soils, extending over a predetermined portion of the length of said sheet pile such that when said sheet pile is driven through the compressible soil and into the harder soil, said friction reduction coating contacts the compressible soil and/or harder soil into which said sheet pile is disposed and decreases the coefficient of friction between said opposed exterior surfaces of said sheet pile and the compressible soil and/or harder soil, thereby reducing friction between said opposing exterior surfaces of said sheet pile and the compressible soil and/or harder soil adjacent said sheet pile when the compressible soil settles downwardly relative to said sheet pile.

2. The sheet pile of claim 1, wherein said pile is fabricated of steel.

3. The sheet pile of claim 1, wherein said friction reduction coating conforms to said opposing exterior surfaces of said sheet pile.

4. A method of reducing skin friction on a sheet pile for application in soils and forming with duplicate ones of the sheet pile a wall structure, comprising the steps of:

providing a sheet pile formed of extruded sheet material, elongated and of constant size and shape along its length and having opposed exterior surfaces and elongated side edges shaped for connection to side edges of duplicate ones of the sheet pile, determining the portions of the piles to contact the soils, and adhering a friction reduction coating to the opposing exterior surfaces of the portions of the sheet piles to contact the soils with enough strength and abrasion resistance to withstand the abrasion forces applied to the pile during driving operations into the soils, and driving the sheet piles into the soils.

5. The method of claim 4, wherein the soils have a compressible soil layer overlying a harder soil layer, and the step of determining the portions of the piles to contact the soils comprises the steps of:

determining the depth of the compressible soil layer, and determining the portions of the piles to contact the compressible soil layer, and; wherein the friction reduction coating is adhered to the opposing exterior surfaces of the portions of the piles to contact the compressible and/or harder soil layers after the piles are driven into the soils.

6. A method of reducing the skin friction on driven sheet pile for application in soils and forming with duplicate ones of the sheet pile a wall structure, comprising the steps of:

providing first and second sheet piles of similar configuration, the first and second sheet piles being of formed sheet material, elongated and of constant size and shape along their lengths and each having opposed exterior surfaces and elongated opposed side edges configured for interlocking with the side edges of the other sheet pile, determining the depth to which the sheet piles are to be disposed into the soil, adhering a friction reduction coating to the opposed exterior surfaces of the portion of the first sheet pile to contact the soil after being driven with enough strength and abrasion resistance to withstand the abrasion forces applied to the pile during driving operations into the soils, driving the portion of the first sheet pile to which the friction reduction coating has been applied into the soil, connecting together a side edge of the first sheet pile and a side edge of the second sheet pile, and driving the portion of the second sheet pile to which the friction reduction coating has been adhered into the soil such that the first and second sheet piles interlock to form a first wall structure.

7. The method of claim 6, wherein the step of determining the depth to which the sheet piles are to be disposed into the soil comprises determining the depth of a compressible layer of the soil and the depth of a harder layer of the soil, and wherein the step of adhering a friction reduction coating to the opposed exterior surfaces comprises adhering the coating to the portion of said opposed exterior surfaces to be disposed in the compressible soil layer.

8. The method of claim 6, further comprising the steps of:

providing third and fourth sheet piles of formed sheet material, elongated and of constant size and shape along their lengths and each having opposed exterior surfaces and elongated opposed side edges configured for interlocking with the side edges of other sheet piles, adhering a friction reduction coating to the opposed exterior surfaces of the portion of the third sheet pile to contact the soil after being driven, driving the portion of the third sheet pile to which the friction reduction coating has been adhered into the soil, connecting together a side edge of the third sheet pile and a side edge of the fourth sheet pile, and driving the portion of the fourth sheet pile to which the friction reduction coating has been adhered into the soil such that the third and fourth sheet piles interlock to form a second wall structure, the second wall structure being spaced from the first wall structure.

9. The method of claim 8, further comprising the steps of:

removing at least a portion of the soil disposed between the first and second wall structures to form an evacuated cavity therebetween, refilling at least a portion of the cavity with fill, and removing the sheet piles from the soil.

10. A method of installing a driven wall structure of sheet pile through compressible soil and harder soil beneath the compressible soil with fill soil applied to the surface of the compressible soil, the wall including a series of elongated sheet piles each having opposed side surfaces, elongated opposed edges shaped for slidably locking to the edge of an adjacent pile, an upper end portion and a lower end portion;

adhering a friction reduction coating to at least one of the side surfaces of at least some of the piles along the lengths of the piles which are to be contacted by the compressible soil and by the fill soil after the piles have been driven into the compressible soil and harder soil, and the fill soil has been added to the surface of the compressible soil, the friction reduction coating having enough strength and abrasion resistance to withstand the abrasion forces applied to the pile during driving operations into the soils;

joining an edge of each pile to another previously driven pile and driving the lower portion of each pile into the compressible soil and the harder soil to a depth at which the friction reduction coating is contacted by the compressible soil;

after the piles have been driven to form the wall structure, applying fill soil on the surface of the compressible soil with the fill soil in contact with the friction reduction coating of the piles; and settling the compressible soil and the fill soil against the friction reduction coating to reduce the friction between the compressible soil and fill soil with respect to said piles as the soils settle.

11. A method of installing a driven wall structure of sheet piles through compressible soil and harder soil beneath the compressible soil, the wall including a series of elongated sheet piles each having opposed side surfaces, elongated opposed edges shaped for slidably locking to the edge of an adjacent pile, and upper end portion and a lower end portion;

adhering a friction reduction coating to at least one of the side surfaces of at least some of the sheet piles along the lengths of the piles which are to be contacted by the compressible soil after the piles have been driven into the compressible soil and the harder soil, the friction reduction coating having enough strength and abrasion resistance to withstand the abrasion forces applied to the pile during driving operations into the soils;

joining an edge portion of each sheet pile to another previously driven sheet pile and driving the lower portion of each pile into the compressible soil and the harder soil with the pile being driven to a depth where the compressible soil engages the reduced friction coating of the pile;

reducing the friction applied by the compressible soil to the pile with the reduced friction coating.

12. The method of claim 11, and further including the step of applying fill soil to the surface of the compressible soil with the fill soil in contact with the reduced friction coating adhered to the piles, and as the soil settles reducing the friction applied by fill soil to the pile with the reduced friction coating.

13. The method of claim 11, and further including the step of lifting the piles along their lengths to a height sufficient to extract the piles from the soils, and as the piles are lifted reducing the friction applied by the soils against the piles with the reduced friction coating.

* * * * *